US005339548A

United States Patent [19]

Russell

[11] Patent Number: 5,339,548

[45] Date of Patent: Aug. 23, 1994

[54] RECEPTACLE DISPLAY ACTIVATED AFTER THE SENSING OF THE CONDITION OF THE LIQUID

[76] Inventor: James M. Russell, 26 Brookview Ter., Bedford, N.H. 03110

[21] Appl. No.: 935,580

[22] Filed: Aug. 26, 1992

[51] Int. Cl.[5] ..... G09F 3/00; F21V 33/00

[52] U.S. Cl. ..... 40/324; 40/463; 362/101

[58] Field of Search ..... 40/324, 463; 215/230; 362/101, 276, 802; 116/200; 307/141

[56] References Cited

U.S. PATENT DOCUMENTS 1,933,763 11/1933 Russell ..... 40/324
2,663,866 12/1953 Simpson ..... 362/101
3,979,601 9/1976 Franklin ..... 307/141
4,922,355 5/1990 Dietz et al. ..... 362/101
5,211,699 5/1993 Tipton ..... 362/101

*Primary Examiner*—Clifford D. Crowder
*Assistant Examiner*—Gloria Hale
*Attorney, Agent, or Firm*—Joseph S. Iandiorio; Kirk Teska

[57] ABSTRACT

A receptacle display includes a receptacle for holding a liquid; display means mounted with the receptacle; and sensing means sealingly mounted with the receptacle for sensing the condition of the liquid in the receptacle and actuating the display means when a predetermined condition of the liquid is sensed.

12 Claims, 5 Drawing Sheets

RECEPTACLE DISPLAY ACTIVATED AFTER THE SENSING OF THE CONDITION OF THE LIQUID

FIELD OF INVENTION

This invention relates to a receptacle display, and more particularly to a receptacle display in which the display is only activated when the liquid in the receptacle reaches a predetermined condition relative to the receptacle.

BACKGROUND OF INVENTION

Liquid receptacles for drinking such as glasses, cups and bowls often have words and/or symbols printed on them so that they are visible all of the time. Other receptacles have games embedded in their bases. Glasses and cups are a common item for advertising, slogans and messages. But these displays are generally fixed for the life of the item and lose their appeal by the very fact that they are fixed and unchanging.

SUMMARY OF INVENTION

It is therefore an object of this invention to provide a new and improved novel receptacle display.

It is a further object of this invention to provide such a receptacle display that can be actuated by the condition of the liquid in the receptacle.

It is a further object of this invention to provide such a receptacle display that can be actuated by the orientation or the level of the liquid in the receptacle.

It is a further object of this invention to provide such a receptacle display that can have visual and/or audio displays.

It is a further object of this invention to provide such a receptacle display in which the display can be changed.

The invention results from the realization that a truly effective receptacle display can be achieved by disposing the display anywhere on the inside or outside of the receptacle and energizing it upon the liquid reaching a predetermined level or orientation relative to the receptacle.

This invention features a receptacle display including a receptacle for holding a liquid and display means mounted with the receptacle. There are sensing means sealingly mounted with the receptacle for sensing the condition of the liquid in the receptacle and actuating the display means when a predetermined condition of the liquid is sensed.

In a preferred embodiment the receptacle may be a drinking receptacle such as a cup or a glass. The display means may be an electronic display which may provide a visual or an audio display, or both. The display means may be located on the outside of the receptacle or on the inside of the receptacle, for example on the inside base of the receptacle. The sensing means may include means for detecting the orientation of the liquid relative to the receptacle or the level of the liquid relative to the receptacle. The sensing means may be disposed in the bottom of the receptacle.

DISCLOSURE OF PREFERRED EMBODIMENT

Other objects, features and advantages will occur to those skilled in the art from the following description of a preferred embodiment and the accompanying drawings, in which.

Figure 1:
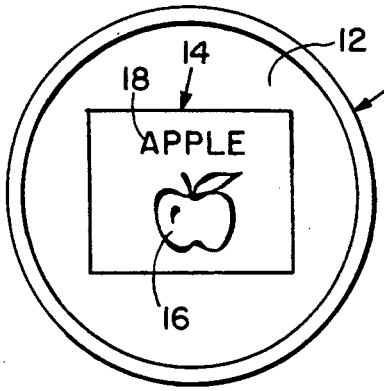
FIG. 1 is a top plan view of a cup with a display on the inside bottom according to this invention.
Figure 2:
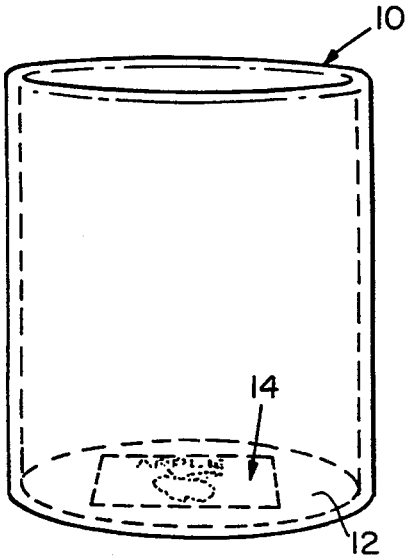
FIG. 2 is a front elevational view of the cup of FIG. 1.
Figure 3:
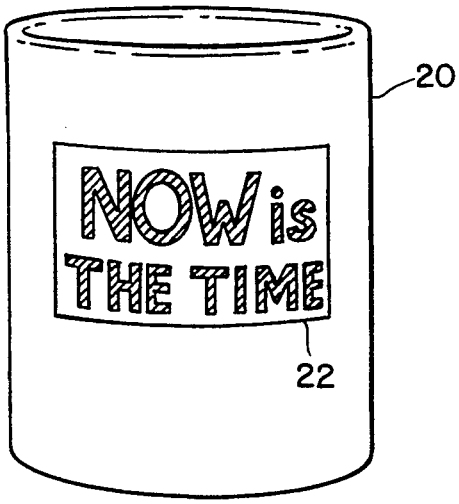
FIG. 3 is a view similar to FIG. 2 of a cup with a display on the outside wall of the cup.

There is shown in FIG. 1 a view looking into a glass 10 having on its inside bottom 12 a display 14 presently showing the symbol or drawing of an apple 16 along with the word "apple" 18. Glass 10 is shown in the upright position in FIG. 2 with display 14 visible only at an angle. The display can be on the inside or the outside, on the side, or on the bottom of glass 10. For example, in FIG. 3, glass 20 bears display 22 on its outside.

Figure 4:
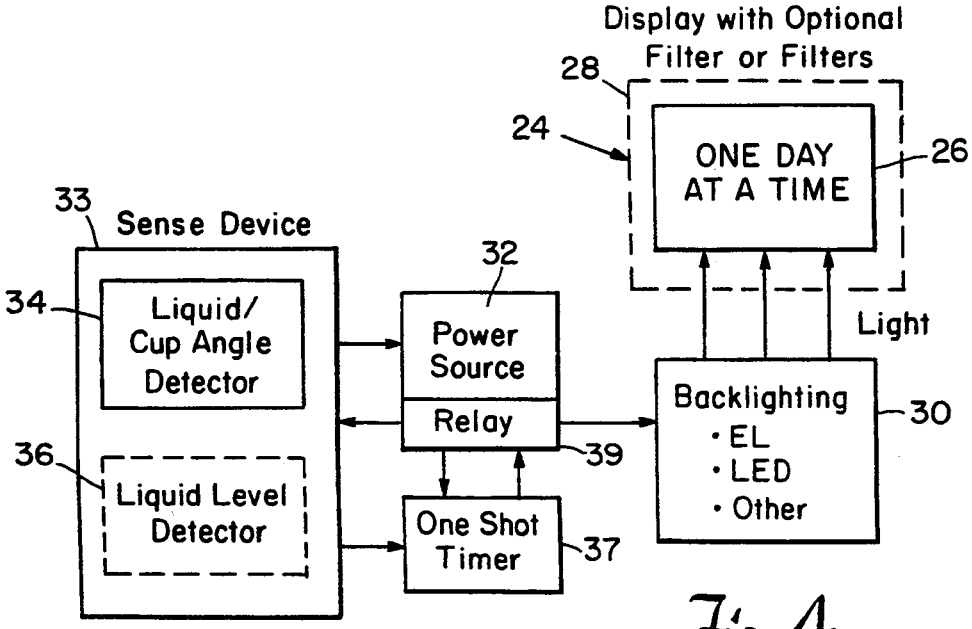
FIG. 4 is a block diagram of a simple display system according to this invention.

One construction for a display in accordance with this invention is shown in FIG. 4, where display 24 includes a glass or plastic transparent material with a permanent image of the phrase "One Day at a Time" etched or printed on it. One or more filters 28 may be employed to mask the display or color the message. The message is lit by a backlighting device such as an LED 30 energized by power source 32 when a predetermined condition of the liquid in the cup or glass is detected. A sensing device 33 which senses the angle of the liquid relative to the cup, detector 34, or which senses the level of the liquid in the cup, detector 36, may be used to actuate one shot timer 37 and relay 39 which, in turn, connect the on/off control of power source 32 to backlighting 30, for controlling the amount of time that the backlighting device 30 will be on.

Figure 5:
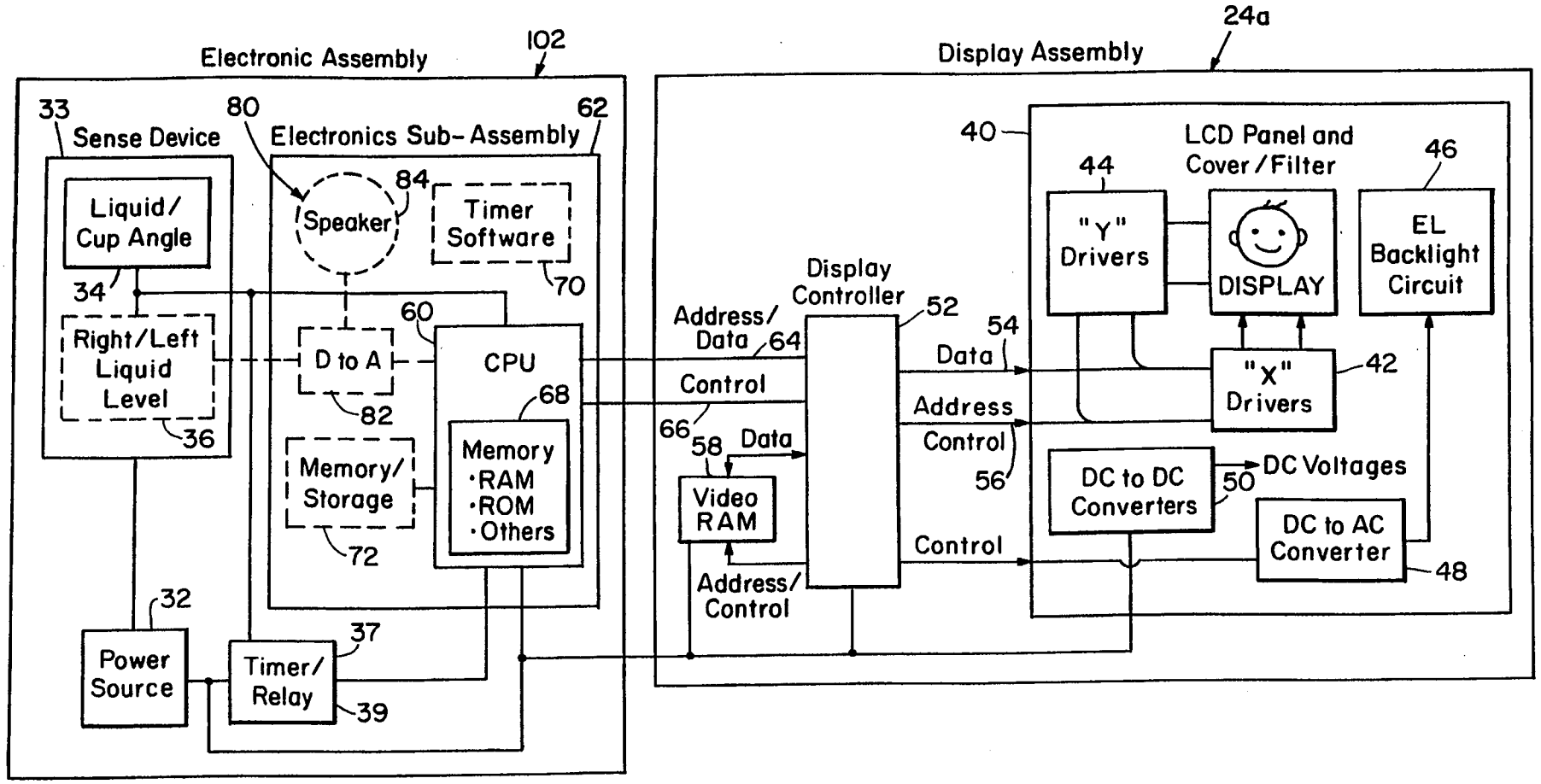
FIG. 5 is a block diagram of a more sophisticated implementation of a receptacle display system according to this invention.

A more sophisticated implementation of the invention is shown in FIG. 5, where display **24*a* includes an LCD panel 40 with X and Y drivers 42 and 44. Illumination is provided from backlight circuit 46, and again filters may be used if desired. Backlight circuit 46 is operated through DC to AC converter 48, which is powered through DC to DC converter 50, which is in turn driven by power source 32. The control input to DC to AC converter 48 is delivered from display controller 52 which determines when the backlight circuit is to be operated. Display controller 52 also selects, via data lines 54 and address and control lines 56**, the X and Y drivers that are to be actuated to provide the proper display.

Display controller 52 has associated with it a video random access memory 58 which contains the data of the image being displayed. CPU 60 in electronic subassembly 62 operates display controller 52 over address-/data bus 64 and control bus 66 to load a particular image into video RAM 58. In this manner, the display not only is switched on and off with the level or orientation of the liquid in the receptacle, but may as well be changed each time the cup is used or each time it is tilted, for example, so that a fresh image is provided frequently throughout the life of the cup and even during a single use of the cup. CPU 60 includes the usual memory 68 hardware including RAM, ROM and the like. Electronic subassembly 62 also includes a software controlled timer 70, that may be separate from or integral with the CPU 60. This timer may be used to control how long the display assembly **24*a* is turned on with relay 39. The timer may be used to count how many times the sensor activates within a predetermined amount of time. It may also be used to display date or time. Additional memory or other types of storage 72 may be used to store additional information to be displayed, or additional programs to be run. In addition to the visual image display 40, an audio display 80 may be provided using for example D to A (digital to analog) converter 82 and speaker 84**, so that visual and/or audio messages can be displayed in response to the condition of the liquid in the cup.

Figure 6:
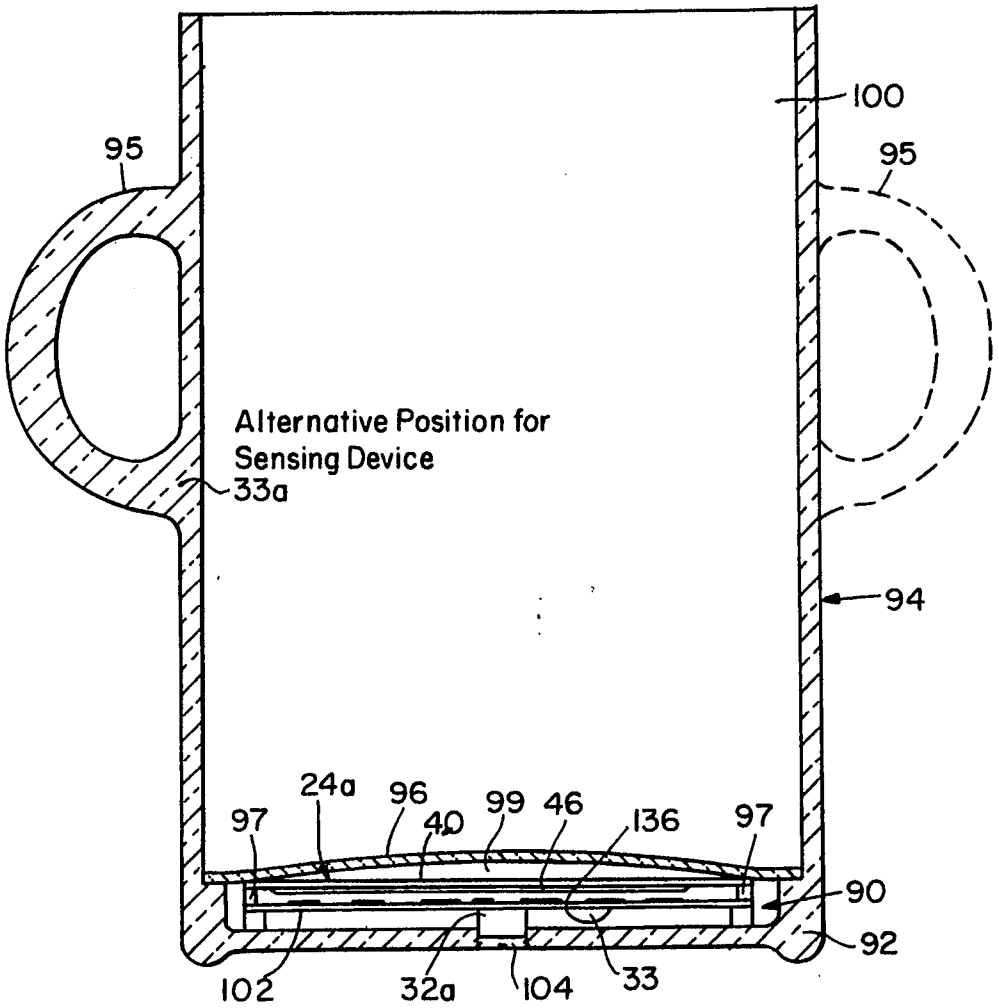
FIG. 6 is a cross-sectional elevational view of a cup showing the location of the electronic circuitry of FIG. 5.

The entire system as shown in FIG. 5 may be disposed in a chamber 90, FIG. 6, in the base 92 of cup 94. Cup 94 includes a sensing device 33, that also detects left or right hand orientation of the cup as shown with handle 95. With right/left hand information from sensing device 33, CPU 60 knows to load bits into video RAM 58 so that the image is always right side up to the user. Relay 39 can be kept closed by a stand-alone timer 30, or through CPU 60, so that the electronic circuitry continues to be powered even after sensor 33 opens. A cover 96 is sealingly engaged with base 92 of cup 94 to prevent liquid from penetrating into chamber 90. The cover may be clear and may itself contain a filter. The bulk of the display assembly outside of the display device itself, as well as the electronic assembly and the sensing device, all may be mounted on printed circuit board 136 in chamber 90. The power source 32 may be a small battery **32*a* easily accessible behind a threaded sealed plug 104. Zebra strip 97 is used for electrical connections and mounting between electronics assembly 102 and display assembly 24a. Air or vacuum space 99 between display cover 96 and LCD panel 40 gives thermal insulation to the display assembly 24*a*. The sensing device 33 is also disposed in chamber 90**.

Figure 7:
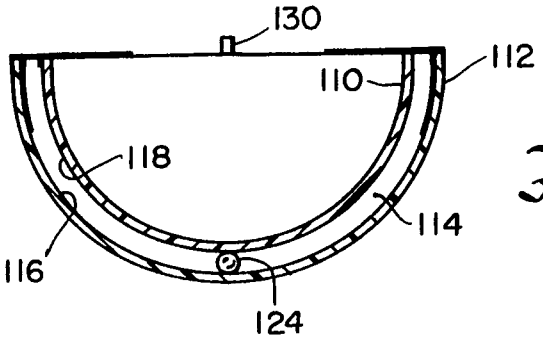
FIG. 7 is a front cross-sectional view of a tilt detecting device usable with this invention.
Figure 8:
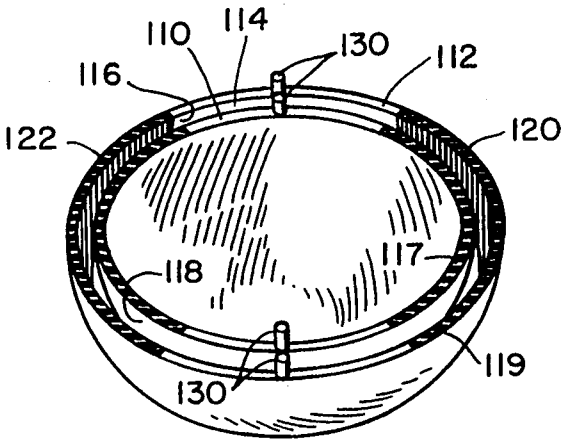
FIG. 8 is a top three-dimensional view of the device of FIG. 7.
Figure 9A:
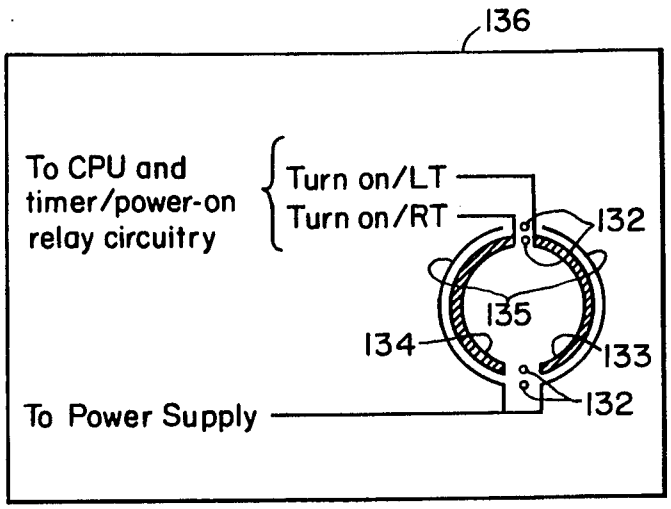
FIG. 9A is a printed circuit board of an electronics assembly showing the etch used in the device of FIG. 7.
Figure 9B:
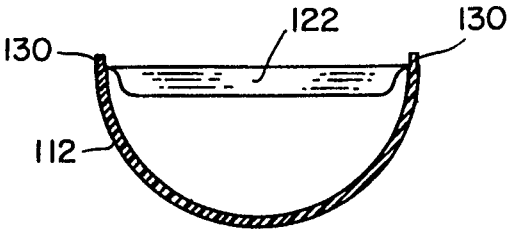
FIG. 9B is a cross-sectional view of the hemisphere of FIGS. 7 and 8.

One such sensing device of the liquid cup angle detector type is shown in FIG. 7, where a pair of concentric hemispheres 110 and 112 are nested inside of each other. Mounting pegs 130, when inserted in alignment holes of printed circuit board FIG. 9A, 136, of electronic assembly 102, maintain a precise and fixed spacing 114 between them. The inside facing surfaces 116 and 118 and top circumferences 117 and 119, are covered with a conductive coating such as copper 120, 122 over a portion of their extent. The copper of the outside hemisphere 112 extends part way down, as can be seen in FIG. 8. The conductive coatings 120, 122 of hemispheres 110 and 112 are soldered to printed circuit board etch, FIG. 9A, 133, 134, 135 by means of surface mounting for a permanent electrical and mechanical contact to the printed circuit board 136 of the electronic assembly 102. The etch, 133 and 134, used to connect to the inside hemisphere 110, is brought up to, but not connected to, etch 135 used for connection to the outside hemisphere. A conductive ball such as a metal ball 124 is sized to easily roll in space 114. When the hemispheres attached to the cup inside chamber 90 tilt with the cup, the ball rolls to one side or the other depending upon whether the person is left handed or right handed. As the cup is tilted 90 degrees relative to the liquid in the cup, ball 124 makes an electrical connection between the outside hemisphere cladding 122, and the printed circuit board etch 133 (left) or 134 (right), thereby closing a circuit which can be used as a momentary switch to initialize the electronics and provide left/right hand user information. This type of sensing device may also be embedded anywhere in the side or handle of the cup if desired, FIG. 6, **33*a***, using wires to bring signals between the sensing device and associated circuitry.

Figure 10:
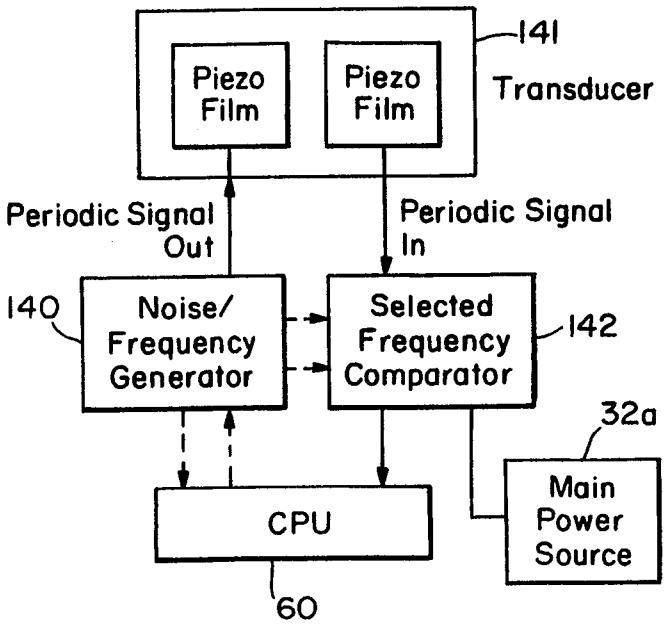
FIG. 10 is a block diagram of a level-sensing device for sensing the level of the liquid relative to the cup according to this invention.

An alternative system , liquid level detector 36, which can be used to energize the electronic assembly, is shown in FIG. 10. For example a simple piezoelectric sound transceiver to sample changes in liquid level, or other types of transceivers and transducers may be used to detect level changes, such as pressure, optical, fluid, mechanical, or surface acoustic waves. One such example is shown in FIG. 10, which illustrates a block diagram of a piezo film based transducer being used for liquid level detection of a cup. This design is based on the fundamental principle that the harmonic frequency of the cup and liquid changes as the amount of liquid in the cup changes. Further, only a small finite amount of approximate liquid levels are needed to give the desired effects on display changes in response to changes in the liquid level in the cup. Finally, all cups of the same design have similar acoustic characteristics, making liquid level detection predictable for all cups made in the same way. The transducer is made up of two piezo films physically apart from one another, embedded in the side/base corner of the cup.

A signal generator 140 generates periodic predetermined frequencies or noise and outputs to the transducer 141. The transducer sends signals back to the selected signal comparator 142 at particular frequencies and power levels dependent on the level of the liquid in the cup. The selected frequency comparator 142 compares the received signal to a limited number of reference frequencies at predetermined amplitudes. Each reference frequency is associated with a different level of liquid in the cup. When the liquid level sensor identifies liquid level changing from empty to not empty, the main power source **32*a* becomes activated, which in turn supplies power to the rest of the electronics. The selected frequency comparator 142 is also connected to the CPU 60**, through either buffering or direct connection. The CPU can poll the signals coming from the selected frequency detector or the selected frequency detector can interrupt the CPU when a change in liquid level occurs.

Figure 11:
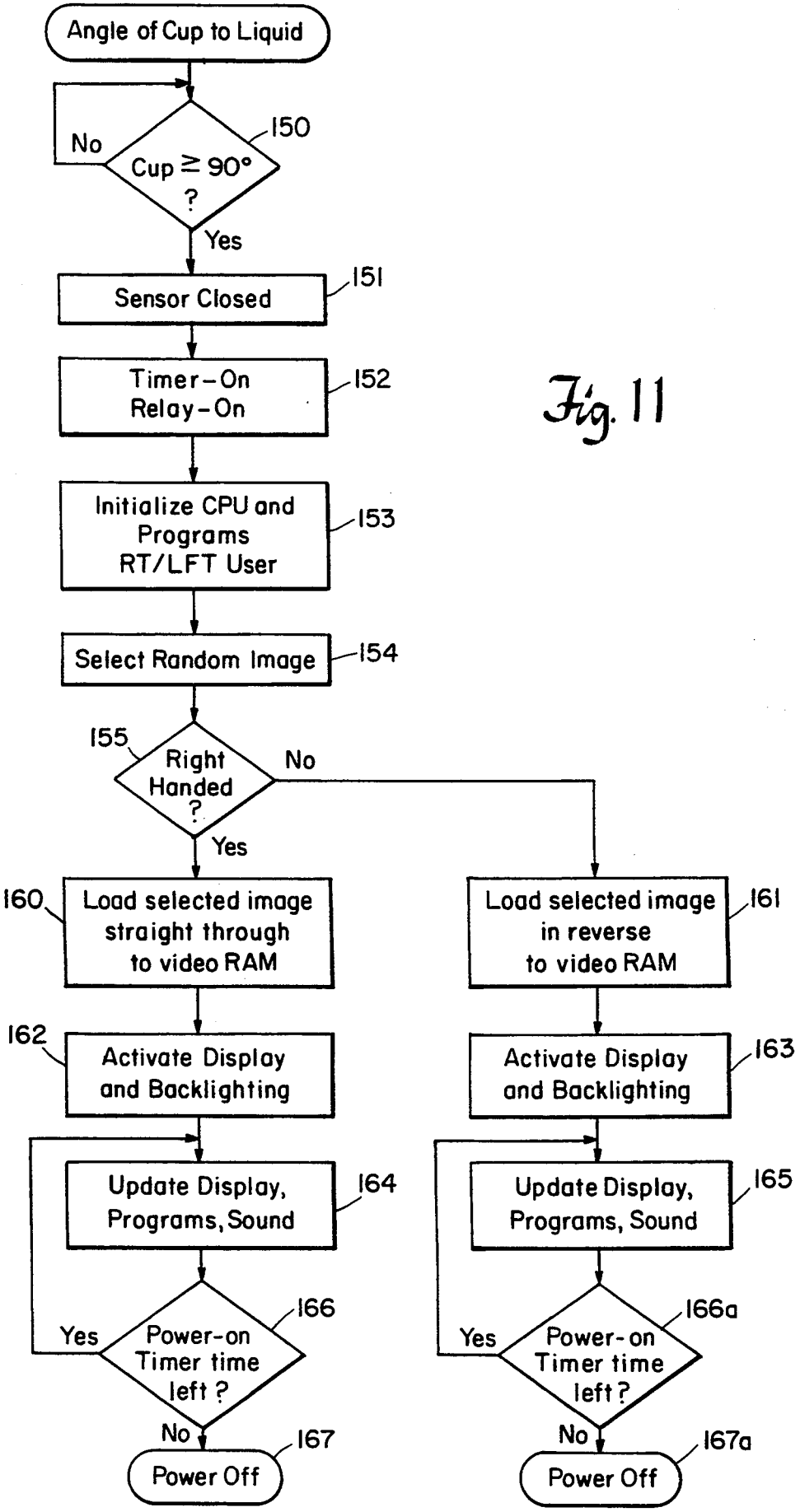
FIG. 11 is a flow diagram of the software for operating the CPU in FIG. 5.

FIG. 11 is a flow diagram of the software for operating the CPU in FIG. 5. The CPU does not receive power until the cup reaches at least a 90 degree angle to the level of the liquid in the cup as shown in decision 150. When the cup does reach 90 degrees relative to the liquid level in the cup, the sensor closes 151, signaling the timer and relay to turn on 152, supplying power to the CPU and associated electronics. The CPU performs power on reset and power on initialization programs 153. This initialization includes polling and storing right/left user data from the sensor and turning on a CPU controlled line to the power-on relay so that power is always supplied while a program is running and continuous power is supplied, regardless of the cup angle orientation.

A random image is then selected 154, and right/left hand user data is used 155, to load video RAM so that the image being displayed is always right side up to the user 160, 161. In this implementation data for right hand users is passed straight through from system memory to video memory. A beginning address counter and byte count of the image is set and the CPU counts down while sequentially loading the image from system memory to video memory. With left handed users, the byte count would be the same, but the CPU starts with the ending image address and count up. With each byte, the bits are reversed, then loaded to video memory. In this way, the image is loaded right side up for left handed users. (Note, a simple pair of data buffers could be designed to pass data straight through or with bit reversal. The CPU would only have to select the right hand buffer, start at the beginning image address and count down, or select the left hand buffer that passes data through with bits reversed by having its input data lines from system memory in reverse order to its output data lines to video memory and start at the ending image address and count up.) At some time after the video RAM has been loaded, the CPU activates the display and backlighting, thereby making the image viewable 162, 163. Images can be changed or updated, sound can accompany any or all images being displayed 164, 165. The image can be text, graphics, bit-mapped image, icon, or any type of image the electronics is capable of loading into video memory.

At the end of each program cycle 164, 165, the CPU tests if sensor relay timer has time left by letting go of the CPU controlled power-on relay line. If power goes away, the CPU turns off. If the CPU still runs, it sets the power-on relay line again to keep the relay on and runs through the program again. This cycle goes on until after the completion of the program run cycle, the timer is tested and time has run out, at which time power is turned off.

Although specific features of the invention are shown in some drawings and not others, this is for convenience only as each feature may be combined with any or all of the other features in accordance with the invention.

Other embodiments will occur to those skilled in the art and are within the following claims:

What is claimed is:

1. A receptacle display comprising:

a receptacle having an outside an inside base and a bottom for holding a liquid;

display means mounted with said receptacle including means for selecting one of a number of images to be displayed;

sensing means sealingly mounted with said receptacle for sensing the condition of the liquid in the receptacle; and a controller responsive to said sensing means for actuating said display means when a predetermined condition of the liquid is sensed and for turning said display means off after a predetermined time.

2. The receptacle display of claim 1 in which said receptacle is a drinking receptacle.

3. The receptacle display of claim 1 in which said receptacle is a cup.

4. The receptacle display of claim 1 in which said display means is an electronic display.

5. The receptacle display of claim 4 in which said display means provides a visual display.

6. The receptacle display of claim 4 in which said display means provides an audio display.

7. The receptacle display of claim 5 in which said display means is located on the outside of said receptacle.

8. The receptacle display of claim 5 in which said display means is located on the inside of said receptacle.

9. The receptacle display of claim 5 in which said display means is located on the inside base of the receptacle.

10. The receptacle display of claim 1 in which said sensing means includes means for detecting the orientation of the liquid relative to said receptacle.

11. The receptacle display of claim 1 in which said sensing means includes means for detecting the level of the liquid relative to said receptacle.

12. The receptacle display of claim 1 in which said sensing means is disposed in the bottom of said receptacle.

* * * * *